US007381111B2

(12) United States Patent
Yun

(10) Patent No.: US 7,381,111 B2
(45) Date of Patent: Jun. 3, 2008

(54) METHOD OF MANUFACTURING FLAT FLUORESCENT LAMP

(75) Inventor: Jae-Doo Yun, Gyeonggi-Do (KR)

(73) Assignee: Mirae Corporation, Cheon, Chungchongnam-Do (KR)

( * ) Notice: Subject to any disclaimer, the term of this patent is extended or adjusted under 35 U.S.C. 154(b) by 294 days.

(21) Appl. No.: 11/079,141

(22) Filed: Mar. 15, 2005

(65) Prior Publication Data

US 2006/0084350 A1 Apr. 20, 2006

(30) Foreign Application Priority Data

Oct. 18, 2004 (KR) ..... 10-2004-0083295

(51) Int. Cl.
*H01J 9/00* (2006.01)
*H05B 33/10* (2006.01)

(52) U.S. Cl. ..... 445/26; 445/38; 445/43; 445/53; 445/33

(58) Field of Classification Search ..... 445/53, 445/24–26, 43, 38, 38.33; 313/545, 566, 313/573, 634–637
See application file for complete search history.

(56) References Cited

U.S. PATENT DOCUMENTS 4,584,501 A * 4/1986 Cocks et al. ..... 313/493
5,387,837 A * 2/1995 Roelevink et al. ..... 313/484
5,543,687 A * 8/1996 Woyke et al. ..... 313/556
5,608,288 A * 3/1997 Haag ..... 313/612
5,917,276 A * 6/1999 Traksel et al. ..... 313/490
6,194,827 B1 * 2/2001 Atagi ..... 313/493
2005/0253513 A1 * 11/2005 Park et al. ..... 313/581
2005/0264160 A1 * 12/2005 Lee et al. ..... 313/485
2006/0061274 A1 * 3/2006 Yoon ..... 313/553

FOREIGN PATENT DOCUMENTS

JP 63211553 A * 9/1988
JP 03-057141 3/1991
JP 04-259-745 9/1992
JP 07-326327 12/1995
JP 10-188810 7/1998
JP 10302718 A * 11/1998

* cited by examiner

*Primary Examiner*—Mariceli Santiago
*Assistant Examiner*—José M. Díaz
(74) *Attorney, Agent, or Firm*—Ked & Associates, LLP

(57) ABSTRACT

A method of manufacturing a surface emitting fluorescent lamp, designed to reduce a total thickness of the surface emitting fluorescent lamp, and to allow easy sealing of a gas injection port. The method comprises forming at least one injection port connected to one side of a discharge channel in a horizontal direction of the fluorescent lamp to communicate with the discharge channel simultaneous with forming a discharge space, providing a sealant within the gas injection port in order to seal the gas injection port, providing a mercury pellet containing mercury to one side of the sealant, vacuum exhausting the discharge space of the fluorescent lamp, diffusing inert gas into the discharge space, and diffusing mercury vapor evaporated from the mercury pellet into the discharge space. Then, the sealant is melted, and seals a connection between the gas injection port and the discharge channel.

16 Claims, 9 Drawing Sheets

METHOD OF MANUFACTURING FLAT FLUORESCENT LAMP

BACKGROUND OF THE INVENTION

1. Field of the Invention

The present invention relates to a method of manufacturing a fluorescent lamp, and, more particularly, to a method of manufacturing a surface emitting fluorescent lamp, which comprises forming a gas injection port for vacuum exhausting a discharge channel of the surface emitting fluorescent lamp and for injecting inert gas into the discharge channel on a side surface of the fluorescent lamp in the horizontal direction to communicate with the discharge channel.

2. Description of the Related Art

Surface emitting fluorescent lamps are widely used in backlight units for flat display diodes, such as liquid crystal displays. The surface emitting fluorescent lamps are generally manufactured by a method comprising forming a glass pipe having a predetermined shape via a high temperature process, coating a phosphor on the inner surface of the glass pipe, exhausting gas from the glass pipe to create a vacuum, and injecting inert gas into the glass pipe. Such a fluorescent lamp has various shapes, such as a straight type, a bent type, a flat type or the like, and typically has a gas injection port formed at one end of the fluorescent lamp for injecting the inert gas and vacuum exhausting.

FIG. 9 is a perspective view illustrating the construction of a conventional surface emitting fluorescent lamp 100. The conventional surface emitting fluorescent lamp 100 is manufactured by connecting a flat-shaped lamp bottom plate 114 to a lamp upper substrate 112. The lamp upper substrate 112 has a single discharge channel, which provides advantages of high brightness and high uniformity in brightness upon light emitting due to its serpentine shape.

The fluorescent lamp 100 has one or more gas injection ports 120, which are formed to an upper portion of the lamp upper substrate 112 in the vertical direction, and which are opened at ends of the injection port 120, so that inert gas is injected into a discharge channel through the end of each of the injection ports 120 after vacuum exhausting gas from the discharge channel therethrough.

FIG. 10 is a cross-sectional view illustrating a vertical cross-section of the center of the gas injection ports 120 shown in FIG. 9. As is seen from FIG. 10, an aperture is formed at each end of the gas injection port and the apertures communicate with the discharge channel of the lamp upper substrate 112. After vacuum exhausting and injecting the inert gas, the gas injection port is heated by a heater, and sealed from the outside.

However, since the conventional fluorescent lamp has the gas injection ports protruded upward, resulting in an increase in the total thickness of the fluorescent lamp, there is a problem of causing a difficulty in providing a light and compact backlight unit using such a conventional fluorescent lamp. Additionally, since vacuum exhausting the discharge channel and injecting the inert gas into the discharge channel must be performed above the fluorescent lamp, there are problems of occupying enlarged working space, and of lowering work efficiency.

SUMMARY OF THE INVENTION

The present invention has been made to solve the above problems, and it is an object of the present invention to provide a method of manufacturing a surface emitting fluorescent lamp, which comprises forming a gas injection port for vacuum exhausting a discharge channel of the surface emitting fluorescent lamp and for injecting inert gas into the discharge channel on a side surface of the fluorescent lamp in the horizontal direction to communicate with the discharge channel, thereby reducing the thickness of the fluorescent lamp, and which also comprises heating a sealant and a mercury pellet previously provided inside the gas injection port, thereby allowing easy sealing of the gas injection port.

In accordance with one aspect of the present invention, the above and other objects can be accomplished by the provision of a method of manufacturing a fluorescent lamp by vacuum exhausting a discharge space for a discharge channel of the fluorescent lamp and diffusing mercury vapor into the discharge space, the method comprising the steps of: forming at least one gas injection port connected to one side of the discharge space in a horizontal direction of the fluorescent lamp to communicate with the discharge space; and providing a gas permeable sealant into the at least one gas injection port in order to seal the at least one gas injection port. At this time, the at least one gas injection port may be integrally formed to the discharge space simultaneously with forming the discharge space.

Additionally, the method of the invention may further comprise the step of providing a mercury pellet containing mercury to one side of the sealant. Furthermore, the method of the invention may further comprise the step of connecting an exhaust pipe to one end of the at least one gas injection port to vacuum exhaust the fluorescent lamp and inject the inert gas into the fluorescent lamp.

In accordance with another aspect of the present invention, there is provided a method of manufacturing a fluorescent lamp by vacuum exhausting a discharge space for a discharge channel of the fluorescent lamp and diffusing mercury vapor into the discharge space, the method comprising the steps of: forming a plurality of gas injection ports connected to one side of the discharge space in a horizontal direction of the fluorescent lamp to communicate with the discharge space; providing gas permeable sealants into the plurality of gas injection ports in order to seal the plurality of gas injection ports, respectively; providing a mercury pellet containing mercury to at least one of the gas injection ports; and connecting a diffusion pipe having a closed leading end to one end of the gas injection port to which the mercury pellet is provided. Additionally, the method of the invention may further comprise the step of connecting an exhaust pipe to one end of another gas injection port, where the mercury pellet is not provided, to vacuum exhaust the fluorescent lamp and inject the inert gas into the fluorescent lamp.

In accordance with still another aspect of the present invention, there is provided a method of manufacturing a fluorescent lamp by vacuum exhausting a discharge space for a discharge channel of the fluorescent lamp and diffusing mercury vapor into the discharge space, the method comprising the steps of: forming at least one gas injection port connected to one side of the discharge space in a horizontal direction of the fluorescent lamp to communicate with the discharge space; and providing a gas permeable sealant into the at least one gas injection port in order to seal the at least one gas injection port, the at least one gas injection port being connected to an injection pipe having one end divided into a plurality of branch pipes, the gas injection port and the injection pipe being formed to an integral body simultaneously with forming the discharge space. Additionally, the method of the invention may further comprise the step of providing a mercury pellet containing mercury to at least one of the plurality of branch pipes, and connecting a diffusion pipe having a closed leading end to one end of the branch pipe to which the mercury pellet is provided. Additionally, the method of the invention may further comprise the step of connecting an exhaust pipe to one end of another branch pipe, where the mercury pellet is not provided, to vacuum exhaust the fluorescent lamp and inject the inert gas into the fluorescent lamp.

In accordance with still another aspect of the present invention, there is provided a method of manufacturing a fluorescent lamp by vacuum exhausting a discharge space for a discharge channel of the fluorescent lamp and diffusing mercury vapor into the discharge space, the method comprising the steps of: forming at least one gas injection port connected to one side of the discharge space in a horizontal direction of the fluorescent lamp to communicate with the discharge space; providing a gas permeable sealant into the at least one gas injection port in order to seal the at least one gas injection port; and connecting an injection pipe having one end divided into a plurality of branch pipes to the at least one gas injection port. Additionally, the method of the invention may further comprise the step of providing a mercury pellet containing mercury to at least one of the plurality of branch pipes, and connecting a diffusion pipe having a closed leading end to one end of the branch pipe to which the mercury pellet is provided. Additionally, the method of the invention may further comprise the step of connecting an exhaust pipe to one end of another branch pipe, where the mercury pellet is not provided, to vacuum exhaust the fluorescent lamp and inject the inert gas into the fluorescent lamp.

Meanwhile, the method may further comprise the steps of exhausting the discharge space of the fluorescent lamp to create a vacuum and diffusing the inert gas into the discharge channel through the exhaust pipe after forming the exhaust pipe vacuum, and diffusing mercury vapor from the mercury pellet into the discharge space. Additionally, the mercury vapor may be diffused by way of evaporating the mercury pellet by means of high frequency wave heating. Additionally, the method may further comprise the step of closing the gas injection port by melting the sealant.

BRIEF DESCRIPTION OF THE DRAWINGS

The foregoing and other objects and features of the present invention will be more clearly understood from the following detailed description taken in conjunction with the accompanying drawings, in which.

DESCRIPTION OF THE PREFERRED EMBODIMENTS

Preferred embodiments will now be described in detail with reference to the accompanying drawings.

Figure 1A:
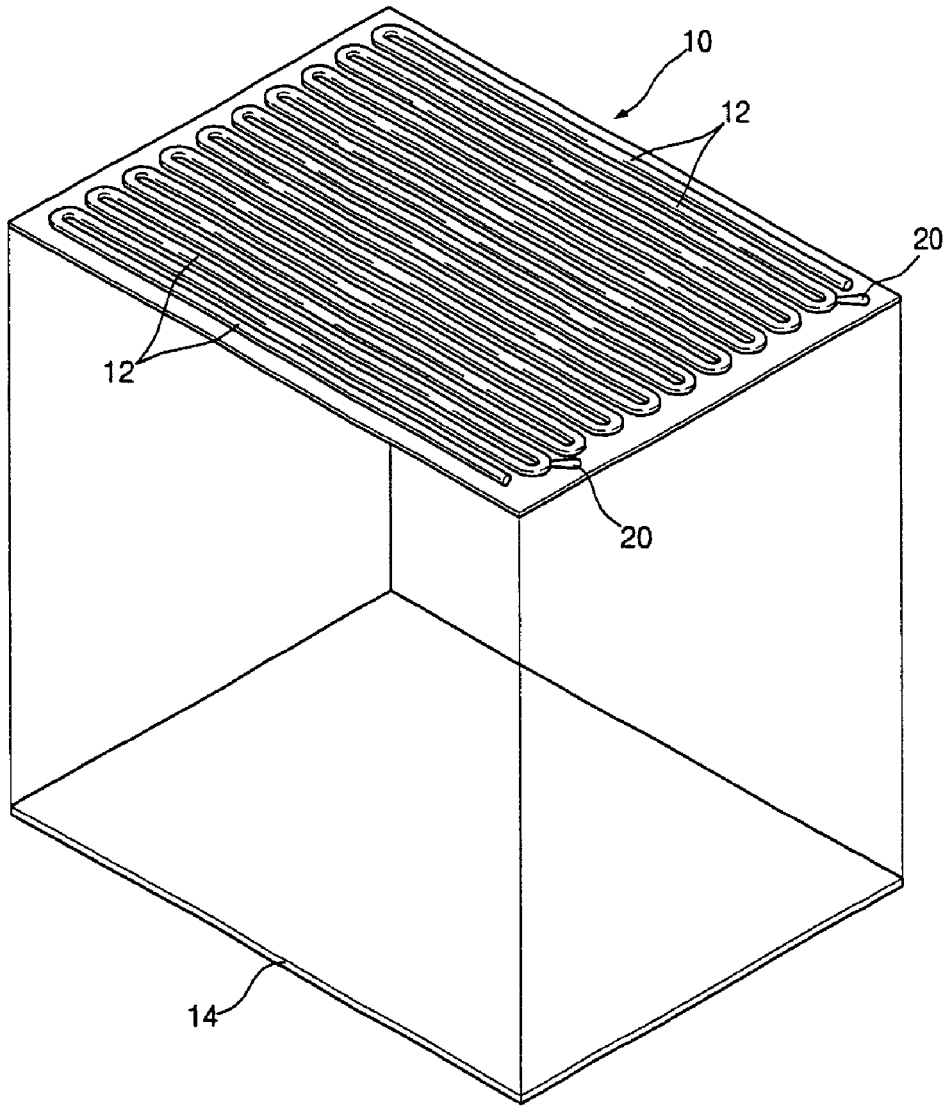
FIG. 1*a* is an exploded perspective view illustrating a surface emitting fluorescent lamp in accordance with a first embodiment of the present invention.
Figure 1B:
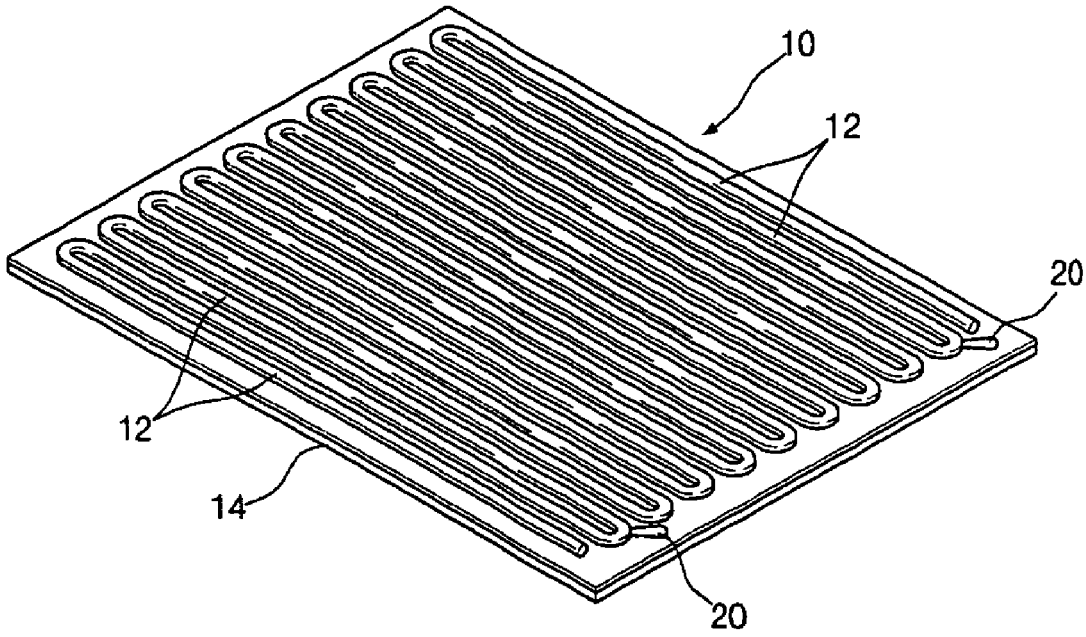
FIG. 1*b* is an assembled perspective view illustrating the surface emitting fluorescent lamp shown in FIG. 1*a;*

FIG. 1*a* is an exploded perspective view illustrating a surface emitting fluorescent lamp 10 in accordance with a first embodiment of the present invention, and FIG. 1*b* is an assembled perspective view illustrating the surface emitting fluorescent lamp 10 shown in FIG. 1*a*. The surface emitting fluorescent lamp 10 comprises a rectangular-shaped lamp upper substrate 12, which comprises a curved surface to provide a channel and a flat surface extended from a side surface of the curved surface, and a flat-shaped lamp lower substrate 14 coupled to the bottom of the lamp upper substrate 12, in which the lamp upper substrate 12 and the lamp lower substrate 14 are integrated by baking after an organic binder is applied thereto. With such a method, the channel of the lamp upper substrate 12 is shielded from the outside, thereby forming a discharge channel 16. At this time, a gas injection port 20 is formed to communicate with a portion of the discharge channel 16. Unlike the conventional gas injection port, the gas injection port 20 of the present invention is not protruded upward, but formed on the flat surface extended from a side surface of the channel of the lamp upper substrate 12. Preferably, the gas injection port 20 is integrally formed to the lamp upper substrate 12, and attached to the lamp lower substrate 14. Meanwhile, although two gas injection ports are illustrated in FIG. 1*b*, it should be noted that the present invention is not limited to this construction, and that one or a plurality of gas injection ports may be installed to the fluorescent lamp.

As a result, the total thickness of the fluorescent lamp can be reduced, thereby enabling to provide a light and compact backlight unit using the fluorescent lamp of the invention, and enhancing work efficiency.

Figure 2A:
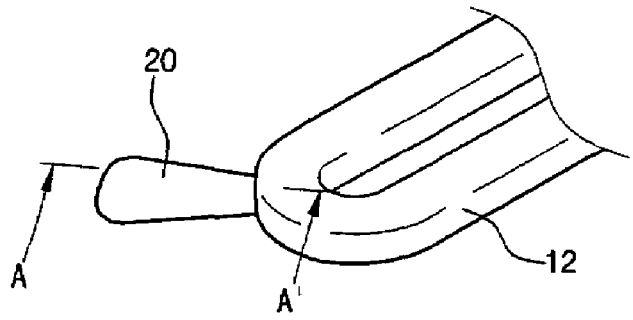
FIG. 2*a* is an enlarged perspective view illustrating a gas injection port shown in FIG. 1*b;*

FIG. 2*a* is an enlarged perspective view illustrating a gas injection port 20 shown in FIG. 1*b*. As shown in FIG. 2*a*, the gas injection port 20 has one end communicated with the channel of the lamp upper substrate 12, and the other end having a closed semicircular shape and extended toward the side surface of the fluorescent lamp 10.

Figure 2B:
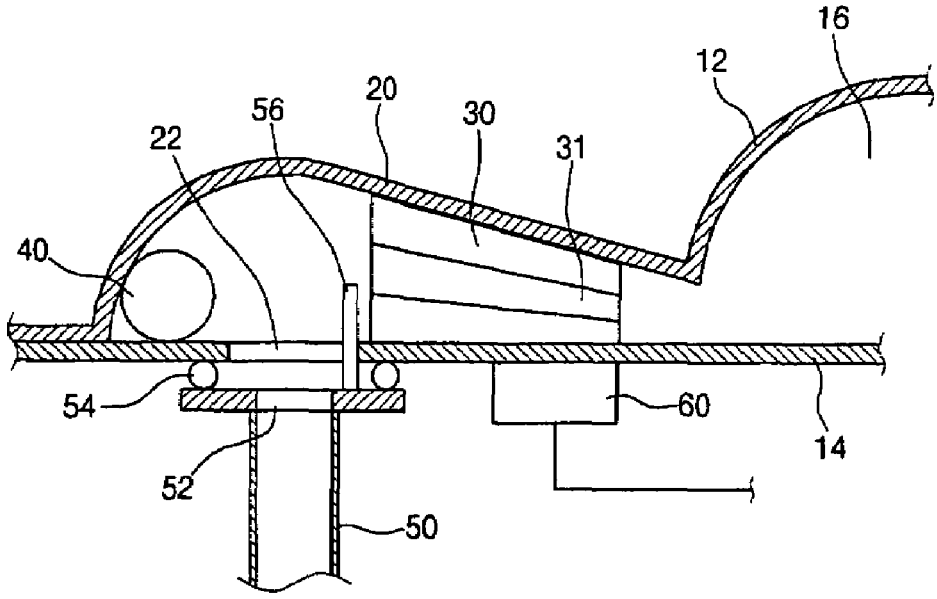
FIG. 2*b* is a cross-sectional view of the gas injection port taken along line A-A' of FIG. 2*a;*

FIG. 2*b* is a cross-sectional view of the gas injection port taken along line A-A' of FIG. 2*a*. The gas injection port 20 has the semicircular-shaped outer end, and is gradually narrowed towards a portion where the gas injection port 20 is connected to the lamp upper substrate 12. Meanwhile, the gas injection port 20 is communicated with the lamp upper substrate 12, so that it can be fluidly communicated with the discharge channel 16. The inside lower surface of the gas injection port 20, that is, the surface of the lamp lower substrate 14 has a vent hole 22 formed therethrough.

A sealant 30 is provided at a predetermined angle inside the gas injection port 20 constructed as described above, and a mercury pellet 40 containing mercury, which will be diffused as mercury vapor into the fluorescent lamp 10, is provided at one side of the sealant 30.

Then, the vent hole 22 is connected to the exhaust pipe 50 having one end corresponding to the size of the vent hole 22, such that air-tightness is maintained between the exhaust pipe 50 and the vent hole 22 by means of an elastic member 54. After connecting the exhaust pipe 50 a vacuum pump (not shown) and to a nozzle (not shown) connected to a tank (not shown) for injecting the inert gas, gas within the fluorescent lamp 10 is exhausted to create a vacuum. After completion of the vacuum exhaust stage, as the inert gas is supplied to the fluorescent lamp 10 with the vacuum pump closed, the inert gas is supplied to the gas injection port 20 through an injection hole 52 formed through the exhaust pipe 50. At this time, the sealant 30 has a groove 31 formed thereon, so that the sealant 30 does not obstruct flow of the gas upon vacuum exhausting or injecting the inert gas. Upon vacuum exhausting or injecting the inert gas, the sealant 30 is prevented from being leaked to the outside by means of a stopper 56 installed to the end of the exhaust pipe.

Next, mercury contained within the mercury pellet 40 is evaporated by use of high frequency wave, so that mercury vapor is uniformly diffused into the discharge channel 16 of the fluorescent lamp 10.

After completion of the inert gas injecting stage and the mercury diffusing stage, the inside of the gas injection port 20, that is, a portion adjacent to the portion where the gas injection port 20 is connected to the lamp upper substrate 12 is heated using a heater 60, and then the sealant 30 is melted, sealing the connection between the gas injection port 20 and the lamp upper substrate 12. In this state, the sealant 30 is cooled, thereby completely closing the gas injection port 20 of the fluorescent lamp 10.

Figure 3:
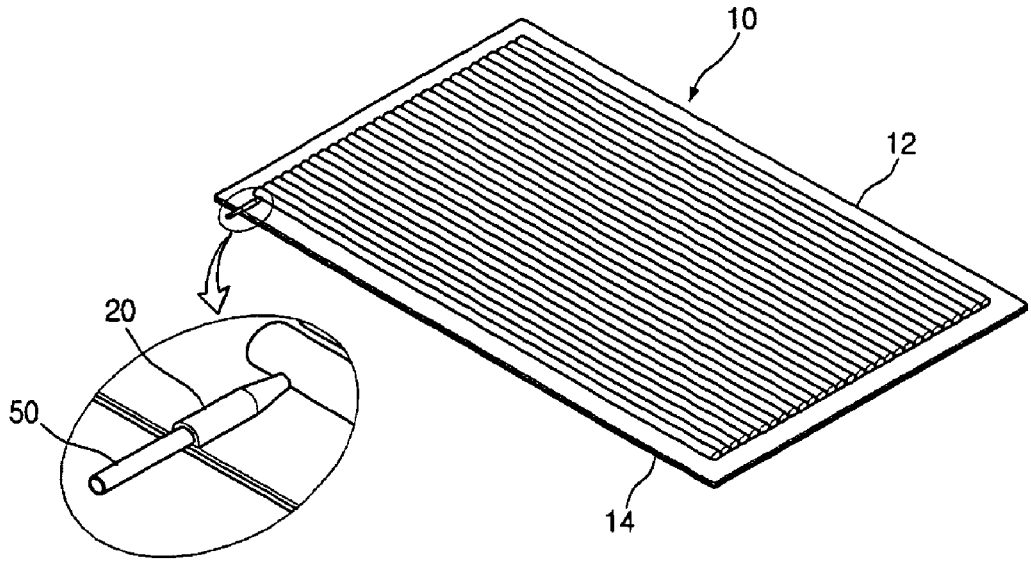
FIG. 3 is a perspective view illustrating a surface emitting fluorescent lamp in accordance with a second embodiment of the present invention.

FIG. 3 is a perspective view illustrating a surface emitting fluorescent lamp 10 in accordance with a second embodiment of the present invention. As with the fluorescent lamp of the first embodiment, the fluorescent lamp 10 of the second embodiment is also manufactured by forming an integral unit comprising a lamp upper substrate and a lamp lower substrate, except that the discharge channel of the fluorescent lamp 20 according to the second embodiment does not have a serpentine shape.

Moreover, the fluorescent lamp 10 according to the second embodiment has a gas injection port 20, which has one end communicated with a portion of a discharge channel of fluorescent lamp 10, and the other end opened to the outside. The gas injection port 20 is formed on a flat surface extended from a side surface of the discharge channel of the lamp upper substrate 12 in the horizontal direction of the discharge channel. Furthermore, the gas injection port 20 may be formed as a single body connected to the lamp upper substrate 12, and located at a position most appropriate for operations, such as vacuum exhaust, injection of inert gas, and the like. Although a single gas injection ports is shown in FIG. 3, it should be noted that the present invention is not limited to this construction, and that a plurality of gas injection ports may be equipped to the fluorescent lamp of the present invention.

Figure 4:
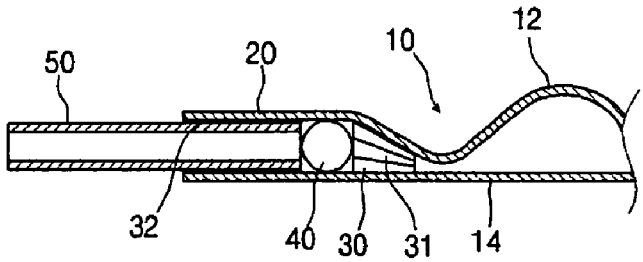
FIG. 4 is a cross-sectional view illustrating a gas injection port shown in FIG. 3.

FIG. 4 is a cross-sectional view illustrating the gas injection port shown in FIG. 3. As shown in FIG. 4, the inner end of the injection pipe 20 is connected to the discharge channel of the lamp upper substrate 12.

A sealant 30 is provided at one side of the gas injection port 20 within the gas injection port 20 constructed as described above, and a mercury pellet 40 containing mercury, which will be diffused as mercury vapor into the fluorescent lamp 10, is provided at one side of the sealant 30. Then, an exhaust pipe 50 having an open leading end is connected to the other side of the gas injection port 20, such that air-tightness is maintained between the exhaust pipe 50 and the gas injection port 20 by means of a sealing pipe 32.

Then, after the exhaust pipe 50 connected to the gas injection port 20 is connected to nozzles (not shown), which are connected to a vacuum pump (not shown) and to a tank (not shown) for injecting the inert gas, respectively, gas is exhausted from the fluorescent lamp 10 to create a vacuum. After completion of the vacuum exhaust stage, as the inert gas is supplied to the fluorescent lamp 10 with the vacuum pump closed, the inert gas is supplied to the gas injection port 20 through the nozzle. At this time, the sealant 30 has a groove 31 formed thereon, so that the sealant does not obstruct flow of the gas upon vacuum exhausting or injecting the inert gas.

Next, mercury embedded within the mercury pellet 40 is evaporated by use of high frequency wave, so that mercury vapor is uniformly diffused into the discharge channel 16 of the fluorescent lamp 10.

After completion of inert gas injection and diffusion of mercury, the inside of the gas injection port 20, that is, a portion adjacent to the portion where the gas injection port 20 is connected to the lamp upper substrate 12 is heated using a heater 60, and then the sealant 30 is melted, sealing the connection between the gas injection port 20 and the lamp upper substrate 12. In this state, the sealant 30 is cooled, thereby completely closing the gas injection port 20 of the fluorescent lamp 10.

Figure 5:
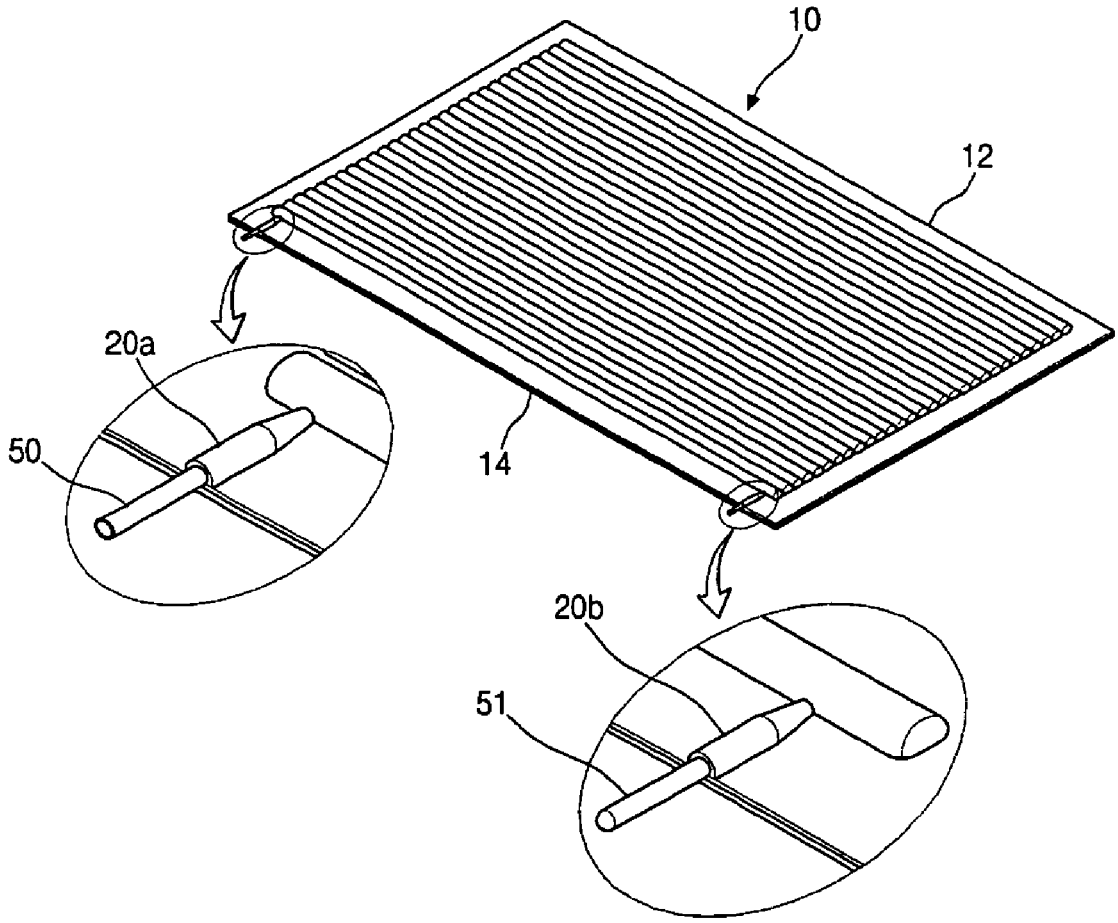
FIG. 5 is a perspective view illustrating a surface emitting fluorescent lamp in accordance with a third embodiment of the present invention.

FIG. 5 is a perspective view illustrating a surface emitting fluorescent lamp 10 in accordance with a third embodiment of the present invention. As with the fluorescent lamp of the second embodiment, the fluorescent lamp 10 of the third embodiment is also manufactured by forming an integral unit comprising a lamp upper substrate and a lamp lower substrate.

As shown in FIG. 5, the fluorescent lamp 10 according to the third embodiment has a pair of gas injection ports 20*a* and 20*b*, each of which has one end communicated with a portion of a discharge channel, and the other end opened to the outside. Each of the pair of the gas injection ports 20*a* and 20*b* is formed on a flat surface extended from a side surface of the discharge channel of the lamp upper substrate 12 of the surface emitting fluorescent lamp 10 in the horizontal direction of the discharge channel, and formed at both ends of one side of the fluorescent lamp 10. Furthermore, each of the gas injection ports 20*a* and 20*b* may be integrally formed as a single body connected to the channel of the lamp upper substrate 12, and located at a position most appropriate for operations, such as vacuum exhaust, injection of inert gas, and the like.

Figure 6A:
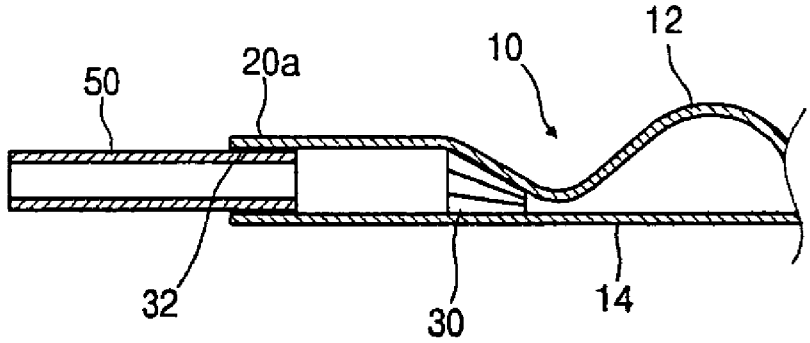
FIGS. 6*a* and 6*b* are cross-sectional views illustrating a gas injection port shown in FIG. 5.
Figure 6B:
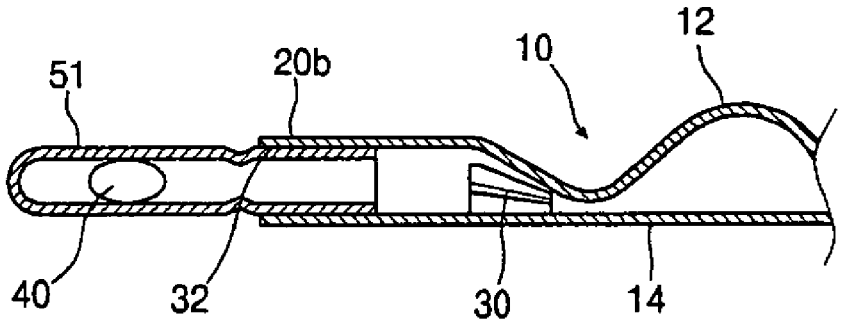

FIGS. 6*a* and 6*b* are cross-sectional views illustrating the gas injection port shown in FIG. 5. As shown in the drawings, the inner end of each injection pipe 20*a* and 20*b* is connected to the discharge channel of the lamp upper substrate 12.

A sealant 30 is provided at one side of each of the gas injection ports 20*a* and 20*b* within each of the gas injection port 20*a* and 20*b* constructed as described above. The gas injection port 20*a* is connected to an exhaust pipe 50 having an open leading end, as shown in FIG. 6*a*, such that air-tightness is maintained between the gas injection port 20*a* and the exhaust pipe 50 by means of a sealing pipe 32, and a gas injection port 20*b* is connected to a diffusion pipe 51 having a closed leading end, as shown in FIG. 6*b*, such that air-tightness is maintained between the gas injection port 20*b* and the diffusion pipe 51 by means of another sealing pipe 32. A mercury pellet 40 containing mercury, which will be diffused as mercury vapor into the fluorescent lamp 10, is provided inside the diffusion pipe 51. As such, the mercury pellet may be embedded in the diffusion pipe, and alternatively, the mercury pellet 40 may be provided to the gas injection port 20*b* before the diffusion pipe 51 is connected to the second gas injection port 22.

Then, after the exhaust pipe 50 is connected to nozzles (not shown), which are connected to a vacuum pump (not shown) and to a tank (not shown) for injecting the inert gas, respectively, gas is exhausted from the fluorescent lamp 10 to create a vacuum. After completion of the vacuum exhaust stage, as the inert gas is supplied to the fluorescent lamp 10 with the vacuum pump closed, the inert gas is supplied to the gas injection port 20*a* through an associated nozzle. At this time, the sealant 30 has a groove 31 formed thereon, so that the sealant 30 does not obstruct flow of the gas upon vacuum exhausting or injecting the inert gas.

As such, after completion of the inert gas injecting stage, the inside of the gas injection port 20*a* connected to the exhaust pipe is heated using a heater 60, and then the sealant 30 is melted, thereby sealing the connections between the gas injection port 20*a* and the lamp upper substrate 12. In this state, the sealant 30 is cooled, thereby completely closing the gas injection port 20*a* of the fluorescent lamp 10.

Then, high frequency waves are transmitted to the mercury pellet 40 embedded within the diffusion pipe 51, so that mercury evaporated from the mercury pellet 40 is diffused into the fluorescent lamp 10. After completion of the mercury diffusing stage, when the inside of the gas injection port 20*b* is heated using the heater (not shown), the sealant 30 is melted, sealing the connection between the gas injection port 20*b* and the lamp upper substrate 12. In this state, the sealant 30 is cooled, thereby completely closing the gas injection port 20*b* of the fluorescent lamp 10.

In the above description, although the process of sealing the connection between the gas injection port 20*a* and the exhaust pipe 50, and the process of sealing the connection between the gas injection port 20*b* and the diffusion pipe 51 are separately performed by heating twice, the present invention is not limited to this process. Alternatively, these processes are performed at the same time after completion of the vacuum exhaust stage, the inert gas injecting stage, and the mercury diffusing stage.

As such, if there is a plurality of gas injection ports, the nozzles for vacuum exhaust and injection of inert gas, and a high frequency wave generator can be separately equipped to the fluorescent lamp, so that not only the mercury pellet is prevented from being detached upon vacuum exhausting and injecting the inert gas, but the size and construction of the fluorescent lamp also be effectively changed.

Figure 7:
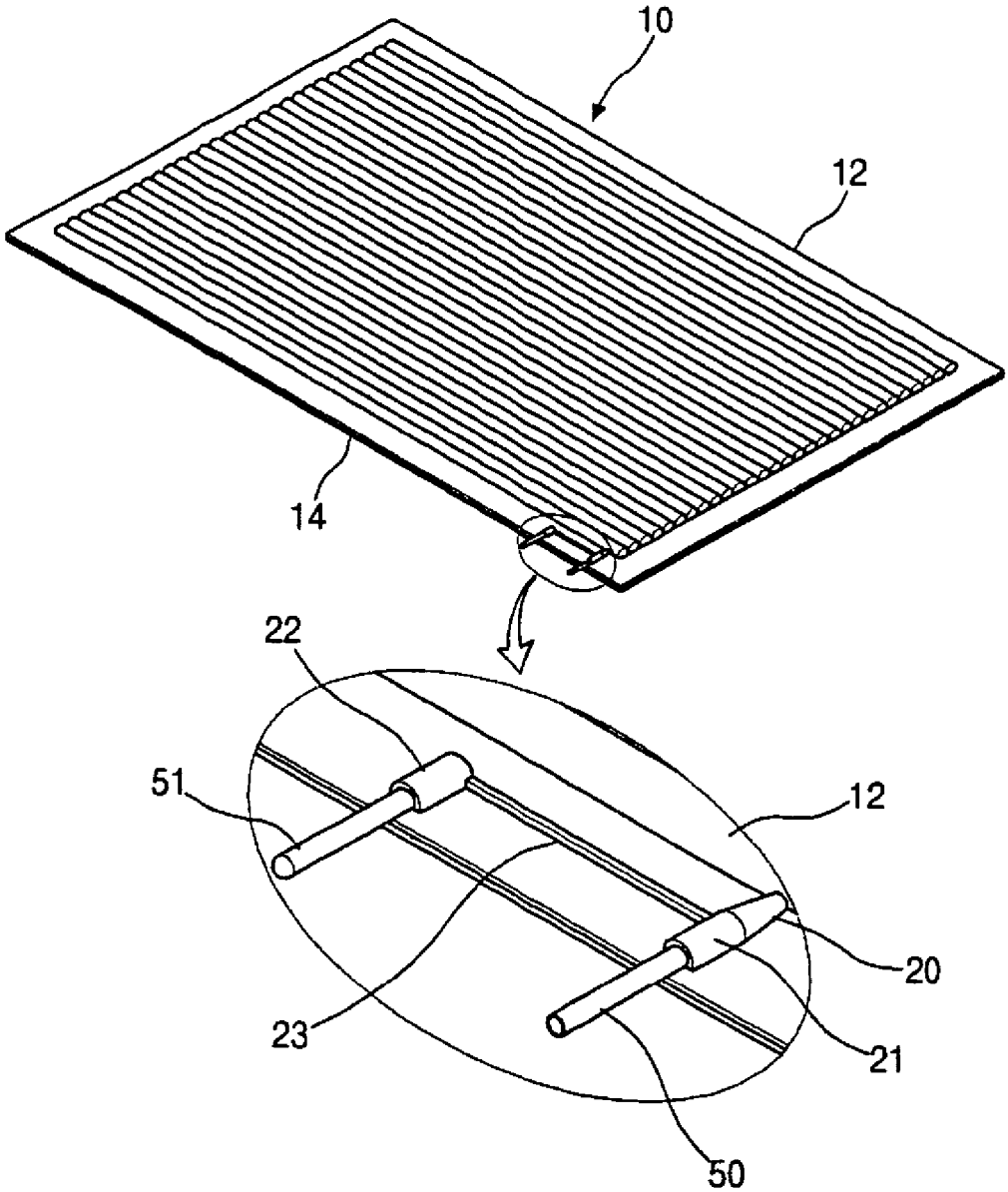
FIG. 7 is a perspective view illustrating a surface emitting fluorescent lamp in accordance with a fourth embodiment of the present invention.

FIG. 7 is a perspective view illustrating a surface emitting fluorescent lamp in accordance with a fourth embodiment of the present invention. As with the fluorescent lamp of the second embodiment, the fluorescent lamp 10 of the fourth embodiment is also manufactured by forming an integral unit comprising a lamp upper substrate and a lamp lower substrate.

Additionally, a gas injection port 20 is formed to communicate with a portion of a discharge channel of the fluorescent lamp 10. The gas injection port 20 is formed on a flat surface extended from a side surface of the discharge channel of the lamp upper substrate 12 in the horizontal direction of the discharge channel.

The gas injection port 20 is connected at one end thereof to an injection pipe 20' divided into a first gas injection port 21 and a second gas injection port 22. The first gas injection port 21 is formed at one side of the injection pipe 20', and has a leading end formed to communicate with an inner portion of the fluorescent lamp 10. The second gas injection port 22 is formed adjacent to the first gas injection port 21, and has a leading end communicated with the first gas injection port 21 through a connecting path 23.

The gas injection port 20 and the injection pipe 20' may be formed as a single body connected to the channel of the lamp upper substrate 12, and located at a position most appropriate for operations, such as vacuum exhaust, injection of inert gas, and the like.

Figure 8:
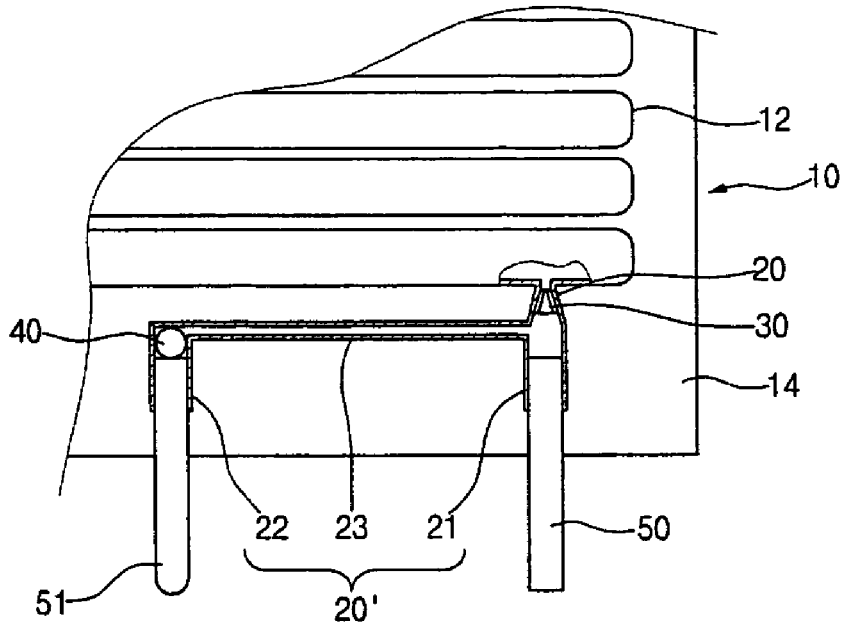
FIG. 8 is a partially enlarged perspective view illustrating a gas injection port shown in FIG. 7.
Figure 9:
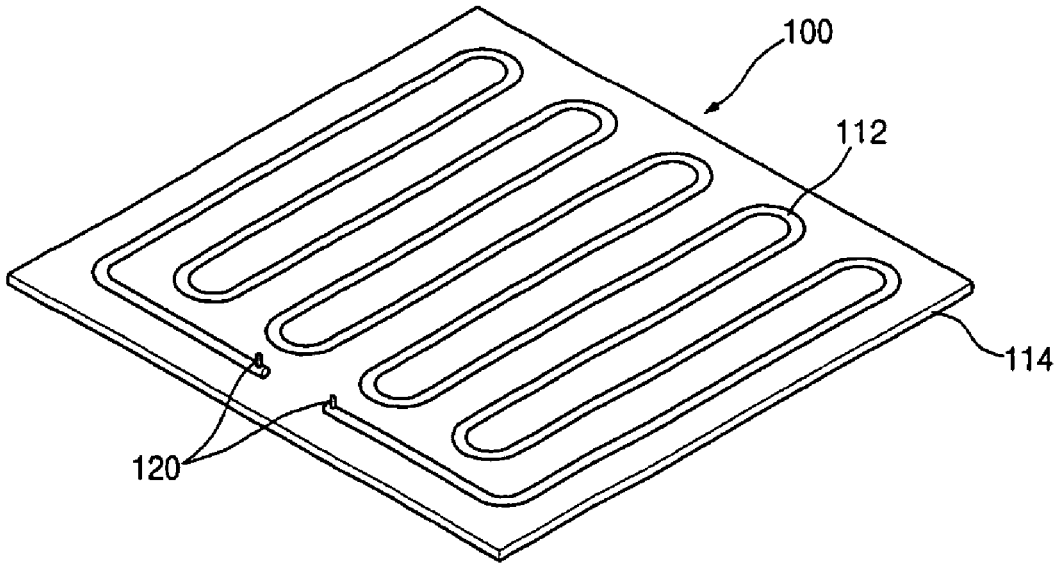
FIG. 9 is a perspective view illustrating a conventional surface emitting fluorescent lamp.
Figure 10:
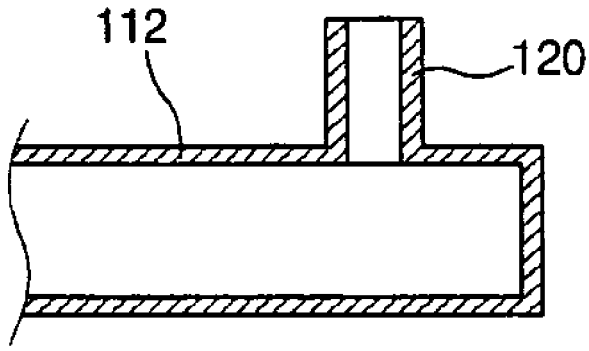
FIG. 10 is a cross-sectional view illustrating a gas injection port of FIG. 9.

A sealant 30 is provided at one side of the gas injection port 20 within the injection port 20 constructed as described above. As shown in FIG. 8, the first gas injection port 21 is connected to an exhaust pipe 50 having an open leading end such that air-tightness is maintained between the first gas injection port 21 and the exhaust pipe 50 by means of a sealing pipe 32, and the second gas injection port 22 is connected to a diffusion pipe 51 having a closed leading end such that air-tightness is maintained between the second gas injection port 22 and the diffusion pipe 51 by means of another sealing pipe 32. A mercury pellet 40 containing mercury, which will be diffused as mercury vapor into the fluorescent lamp 10, is provided inside a diffusion pipe 51. As such, the mercury pellet 40 may be embedded in the diffusion pipe, and alternatively, the mercury pellet 40 may be preinstalled to the second gas injection port 22 before the diffusion pipe 51 is connected to the second gas injection port 22 as shown in FIG. 8.

Then, after the exhaust pipe 50 is connected to nozzles (not shown), which are connected to a vacuum pump (not shown) and to a tank (not shown) for injecting the inert gas, respectively, gas is exhausted from the fluorescent lamp 10 to create a vacuum. After completion of the vacuum exhaust stage, as the inert gas is supplied to the fluorescent lamp 10 with the vacuum pump closed, the inert gas is supplied to the gas injection port 20 through an associated nozzle. At this time, the sealant 30 has a groove 31 formed thereon, so that the sealant 30 does not obstruct flow of the gas upon vacuum exhausting or injecting the inert gas.

As such, after completion of the inert gas injecting stage, high frequency waves are transmitted to the mercury pellet 40 embedded within the diffusion pipe 51, so that mercury evaporated from the mercury pellet 40 is diffused into the fluorescent lamp 10. After completion of the mercury diffusing stage, when the inside of the gas injection port 20 is heated using the heater (not shown), the sealant 30 is melted, sealing the connection between the gas injection port 20 and the lamp upper substrate 12. In this state, the sealant 30 is cooled, thereby completely closing the gas injection port 20 of the fluorescent lamp 10.

Meanwhile, in the fourth embodiment of the invention, the injection pipe 20' divided into the first and second gas injection ports, and the gas injection port 20 are provided as the single body connected to the fluorescent lamp. However, it must be noted that the present invention is not limited to this construction, and that after integrally forming the gas injection port 20 to the fluorescent lamp, the injection pipe 20' divided into the first and second gas injection ports is connected to the gas injection port 20, thereby providing the same effect as that of the fourth embodiment.

In the above description, although some of the embodiments have the stripe type discharge channel, and others have the serpentine type discharge channel, it must be noted that these embodiments are provided as examples, and that the present invention is not limited to these embodiments.

As apparent from the above description, according to the present invention, the gas injection port for vacuum exhausting the discharge channel of the surface emitting fluorescent lamp and for injecting the inert gas into the discharge channel is formed horizontal to the upper surface of the discharge channel on a flat panel extended from a side surface of the fluorescent lamp, thereby reducing the thickness of the fluorescent lamp, and the sealant is preinstalled inside the gas injection port, thereby allowing easy sealing of the gas injection port.

Furthermore, the injection pipe connected to the nozzle for vacuum exhaust and gas injection, and the diffusion pipe for diffusion of mercury are separately provided to the fluorescent lamp, thereby preventing defective products from being produced due to detachment of the mercury pellet.

It should be understood that the embodiments and the accompanying drawings have been described for illustrative purposes and the present invention is limited by the following claims. Further, those skilled in the art will appreciate that various modifications, additions and substitutions are allowed without departing from the scope and spirit of the invention as set forth in the accompanying claims.

What is claimed is:

1. A method of manufacturing a flat fluorescent lamp (FFL), the method comprising:

attaching a first substrate to a second substrate to form a discharge channel defining a discharge space therebetween;

forming at least one gas injection port at a side of the discharge channel and aligned along a horizontal direction of the FFL, wherein the at least one gas injection port is in communication with the discharge space; and providing a sealant in the at least one gas injection port so as to seal the at least one gas injection port, wherein the at least one gas injection port comprises a plurality of gas injection ports, and wherein the method further comprises:

providing a mercury pellet containing mercury in at least one of the plurality of the gas injection ports; and connecting an open end of a diffusion pipe to an end of the gas injection port to which the mercury pellet is provided, wherein the other end of the diffusion pipe is closed.

2. The method as set forth in claim 1, further comprising:

connecting an exhaust pipe to a first end of another of the gas injection ports to which the mercury pellet is not provided;

vacuum exhausting the discharge space; and injecting inert gas into the discharge space.

3. A method of manufacturing a flat fluorescent lamp (FFL), the method comprising:

attaching a first substrate to a second substrate to form a discharge channel defining a discharge space therebetween;

forming at least one gas injection port at a side of the discharge space in a channel and aligned along a horizontal direction of the FFL, wherein the at least one gas injection port is in communication with the discharge space;

providing a sealant in the at least one gas injection port so as to seal the at least one gas injection port; and connecting an injection pipe having one end divided into a plurality of branch pipes to the at least one gas injection port, wherein the gas injection port and the injection pipe are integrally and simultaneously formed with the discharge space.

4. The method as set forth in claim 3, further comprising:

providing a mercury pellet containing mercury to at least one of the plurality of branch pipes; and connecting an open end of a diffusion pipe to an end of the branch pipe to which the mercury pellet is provided, wherein the other end of the diffusion pipe is closed.

5. The method as set forth in claim 4, further comprising:

connecting an exhaust pipe to an end of another branch pipe to which the mercury pellet is not provided;

vacuum exhausting the discharge space; and injecting inert gas into the discharge space.

6. A method of manufacturing a flat fluorescent lamp (FFL), the method comprising:

attaching a first substrate to a second substrate to form a discharge channel defining a discharge space therebetween;

forming at least one gas injection port at a side of the discharge space in a channel and aligned along a horizontal direction of the FFL, wherein the at least one gas injection port is in communication with the discharge space;

providing a sealant in the at least one gas injection port so as to seal the at least one gas injection port; and connecting a first end of an injection pipe to the at least one gas injection port, wherein a second end of the injection pipe is divided into a plurality of branch pipes.

7. The method as set forth in claim 6, further comprising:

providing a mercury pellet containing mercury in at least one of the plurality of branch pipes; and connecting an open end of a diffusion pipe to an end of the branch pipe to which the mercury pellet is provided, wherein the other end of the diffusion pipe is closed.

8. The method as set forth in claim 7, further comprising:

connecting an exhaust pipe to an end of another of the branch pipes to which the mercury pellet is not provided;

vacuuming exhausting the discharge space; and injecting inert gas into the discharge space.

9. A method of manufacturing a flat fluorescent lamp (FFL), the method comprising:

attaching a first substrate to a second substrate to form a discharge channel defining a discharge space therebetween;

forming at least one gas injection port at a side of the discharge space in a channel and aligned along a horizontal direction of the FFL, wherein the at least one gas injection port is in communication with the discharge space;

providing a sealant in the at least one gas injection port so as to seal the at least one gas injection port;

vacuum exhausting the discharge space; and injecting inert gas into the discharge space, wherein vacuum exhausting the discharge space and injecting inert gas into the discharge space comprises:

vacuum exhausting the discharge space, and thereafter diffusing inert gas into the discharge space through the exhaust pipe; and diffusing mercury contained in the mercury pellet into the discharge space, and wherein diffusing mercury into the discharge space comprises evaporating the mercury pellet by high frequency wave heating and melting the sealant to seal the gas injection port.

10. The method as set forth in claim 2, wherein vacuum exhausting the discharge space and injecting inert gas into the discharge space comprises:

vacuum exhausting the discharge space, and thereafter diffusing inert gas into the discharge space through the exhaust pipe; and diffusing mercury contained in the mercury pellet into the discharge space.

11. The method as set forth in claim 5, wherein vacuum exhausting the discharge space and injecting inert gas into the discharge space comprises:

vacuum exhausting the discharge space, and thereafter diffusing inert gas into the discharge space through the exhaust pipe; and diffusing mercury contained in the mercury pellet into the discharge space.

12. The method as set forth in claim 8, wherein vacuum exhausting the discharge space and injecting inert gas into the discharge space comprises:

vacuum exhausting the discharge space, and thereafter diffusing inert gas into the discharge space through the exhaust pipe; and diffusing mercury contained in the mercury pellet into the discharge space.

13. A method of manufacturing a flat fluorescent lamp (FFL), the method comprising:

attaching a first substrate to a second substrate to form a discharge channel defining a discharge space therebetween;

forming at least one gas injection port at a side of the discharge space in a channel and aligned along a horizontal direction of the FFL, with the discharge space; and providing a sealant into in the at least one gas injection port so as to seal the at least one gas injection port and vacuum exhausting the discharge space; and injecting inert gas into the discharge space wherein connecting an exhaust pipe to a first end of the at least one gas injection port comprises connecting the exhaust pipe to a first open end of the at least one gas injection port that is opposite a second end of the at least one gas injection port coupled to the discharge channel.

14. The method as set forth in claim 1, wherein connecting an open end of a diffusion pipe to an end of the gas injection port comprises coupling an open second end of the diffusion pipe to the first end of the gas injection port which is opposite a second end thereof coupled to the discharge space.

15. A method of manufacturing a flat fluorescent lamp (FFL) having a discharge channel with a discharge space formed therein, the method comprising:

forming a plurality of gas injection ports at a side of the discharge channel and aligned along a horizontal direction of the FFL so as to communicate with the discharge space;

providing a sealant into at least one of the gas injection ports;

providing a mercury pellet in at least one of the plurality of the gas injection ports; and connecting a diffusion pipe having a closed end to one end of the gas injection port to which the mercury pellet is provided.

16. A method of manufacturing a flat fluorescent lamp (FFL) having a discharge channel with a discharge space formed therein, the method comprising:

forming at least one gas injection port at a side of the discharge channel aligned along a horizontal direction of the FFL so as to communicate with the discharge space;

providing a sealant into the at least one gas injection port; and connecting an injection pipe having one end divided into a plurality of branch pipes to the at least one gas injection port.

* * * * *